US011005157B2

(12) United States Patent
Hirai

(10) Patent No.: US 11,005,157 B2
(45) Date of Patent: May 11, 2021

(54) LIQUID CRYSTAL CELL AND SCANNING ANTENNA

(71) Applicant: SHARP KABUSHIKI KAISHA, Sakai (JP)

(72) Inventor: Akira Hirai, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 4 days.

(21) Appl. No.: 16/516,610

(22) Filed: Jul. 19, 2019

(65) Prior Publication Data

US 2020/0044307 A1 Feb. 6, 2020

Related U.S. Application Data

(60) Provisional application No. 62/713,898, filed on Aug. 2, 2018.

(51) Int. Cl.

| | |
|---|---|
| ***H01Q 1/22*** | (2006.01) |
| ***H01Q 13/10*** | (2006.01) |
| ***H01Q 9/04*** | (2006.01) |

(52) U.S. Cl.

CPC ..... *H01Q 1/2283* (2013.01); *H01Q 9/0407* (2013.01); *H01Q 13/10* (2013.01)

(58) Field of Classification Search

None

See application file for complete search history.

(56) References Cited

U.S. PATENT DOCUMENTS

| | | | | |
|---|---|---|---|---|
| 2018/0138593 | A1 | 5/2018 | Nakazawa et al. | |
| 2018/0138594 | A1 | 5/2018 | Orui et al. | |
| 2019/0229431 | A1* | 7/2019 | Asagi | H01L 27/124 |

FOREIGN PATENT DOCUMENTS

| | | | | |
|---|---|---|---|---|
| WO | 2017/065255 | A1 | 4/2017 | |
| WO | 2017/130489 | A1 | 8/2017 | |
| WO | WO-2018038209 | A1 * | 3/2018 | H01L 27/124 |

* cited by examiner

*Primary Examiner* — Jany Richardson

(74) *Attorney, Agent, or Firm* — ScienBiziP, P.C.

(57) ABSTRACT

A liquid crystal cell including antenna units includes a TFT substrate, a slot substrate, an acidic group-containing orientation film, a liquid crystal layer, and a sealant. The TFT substrate includes a first dielectric substrate, TFTs supported by the first dielectric substrate, and patch electrodes electrically connected to the TFTs. The slot substrate includes a second dielectric substrate and a slot electrode supported by the second dielectric substrate and including slots. The acidic group-containing orientation film on a surface of one of the TFT substrate and the slot substrate contains a polymer having an acidic group. The liquid crystal layer is interposed between the TFT substrate and the slot substrate in which the patch electrodes and the slot electrode are opposed to each other to constitute the antenna units. The sealant surrounds the liquid crystal layer and is interposed between the TFT substrate and the slot substrate.

20 Claims, 13 Drawing Sheets

LIQUID CRYSTAL CELL AND SCANNING ANTENNA

CROSS REFERENCE TO RELATED APPLICATION

This application claims priority from U.S. Provisional Patent Application No. 62/713,898 filed on Aug. 2, 2018. The entire contents of the priority application are incorporated herein by reference.

TECHNICAL FIELD

The technology described herein relates to a liquid crystal cell and a scanning antenna.

BACKGROUND ART

An antenna used for mobile communication, satellite broadcasting, and the like requires a beam scanning function that can change the beam direction. As an antenna having such a function, there has been proposed a scanning antenna utilizing large dielectric anisotropy (birefringence) of liquid crystal (including nematic liquid crystal and polymer dispersed liquid crystal) (for example, international publications WO 2017/065255 and WO 2017/130489). This type of scanning antenna has a configuration in which a liquid crystal layer is sandwiched between a pair of electrode-attached substrates (that is, a liquid crystal cell for scanning antenna).

A scanning antenna requires a liquid crystal layer using a liquid crystal compound (for example, an isothiocyanate group-containing liquid crystal compound) with a sufficient level of dielectric anisotropy ($\Delta\varepsilon$) in the gigahertz band. However, when a liquid crystal compound high in dielectric anisotropy ($\Delta\varepsilon$) is used, ionic impurities are prone to dissolve from a sealant surrounding the liquid crystal layer, a sealing portion for sealing a liquid crystal injection port provided in part of the sealant, and the like, into the liquid crystal layer. Therefore, it has been a problem that the voltage holding ratio (VHR) of the liquid crystal cell is lowered due to the influence of such impurities.

SUMMARY

An object of the technology described herein is to provide a liquid crystal cell or the like for a scanning antenna in which a decrease in voltage holding ratio is suppressed.

A liquid crystal cell in which a plurality of antenna units is arrayed includes: a TFT substrate that has a first dielectric substrate and a plurality of TFTs supported by the first dielectric substrate and a plurality of patch electrodes electrically connected to the TFTs; a slot substrate that has a second dielectric substrate and a slot electrode supported by the second dielectric substrate and including a plurality of slots; an acidic group-containing orientation film that is provided on a surface of at least one of the TFT substrate and the slot substrate and contains a polymer having an acidic group; a liquid crystal layer that is interposed between the TFT substrate and the slot substrate in which the patch electrodes and the slot electrode are opposed to each other to constitute the antenna units; and a sealant that surrounds the liquid crystal layer and is interposed between the TFT substrate and the slot substrate.

In this way, even if ionic impurities are dissolved from the sealant or the like into the liquid crystal layer, the acidic group-containing orientation film can capture the impurities.

This suppresses floating of the impurities in the liquid crystal layer, and suppresses a decrease in voltage holding ratio of the liquid crystal cell.

According to the technology described herein, it is possible to provide a liquid crystal cell or the like for a scanning antenna in which a decrease in voltage holding ratio is suppressed.

DETAILED DESCRIPTION

The scanning antenna has a beam scanning function by which to change the beam direction and is structured to include a plurality of antenna units utilizing the anisotropy (birefringence) of a large dielectric constant M ($\varepsilon_M$) of the liquid crystal material. The scanning antenna controls the voltage applied to the liquid crystal layer of each antenna unit, and changes the effective dielectric constant M ($\varepsilon_M$) of the liquid crystal layer of each antenna unit, thereby setting a plurality of antenna units having different capacitances. Form a two-dimensional pattern. Since the dielectric constant of the liquid crystal material has frequency dispersion, the dielectric constant in the microwave frequency band may be particularly referred to as "dielectric constant M ($\varepsilon_M$)" in this description.

The electromagnetic wave (for example, microwave) emitted from the scanning antenna or received by the scanning antenna is given a phase difference according to the electrostatic capacitance of each antenna unit, and has strong directivity in a specific direction according to a two-dimensional pattern formed by the plurality of antenna units different in electrostatic capacitance (beam scanning). For example, the electromagnetic wave emitted from the scanning antenna is obtained by integrating spherical waves resulting from input electromagnetic waves having been incident on each antenna unit and having been dispersed by each antenna unit in consideration to the phase difference given by each antenna units.

Figure 1:
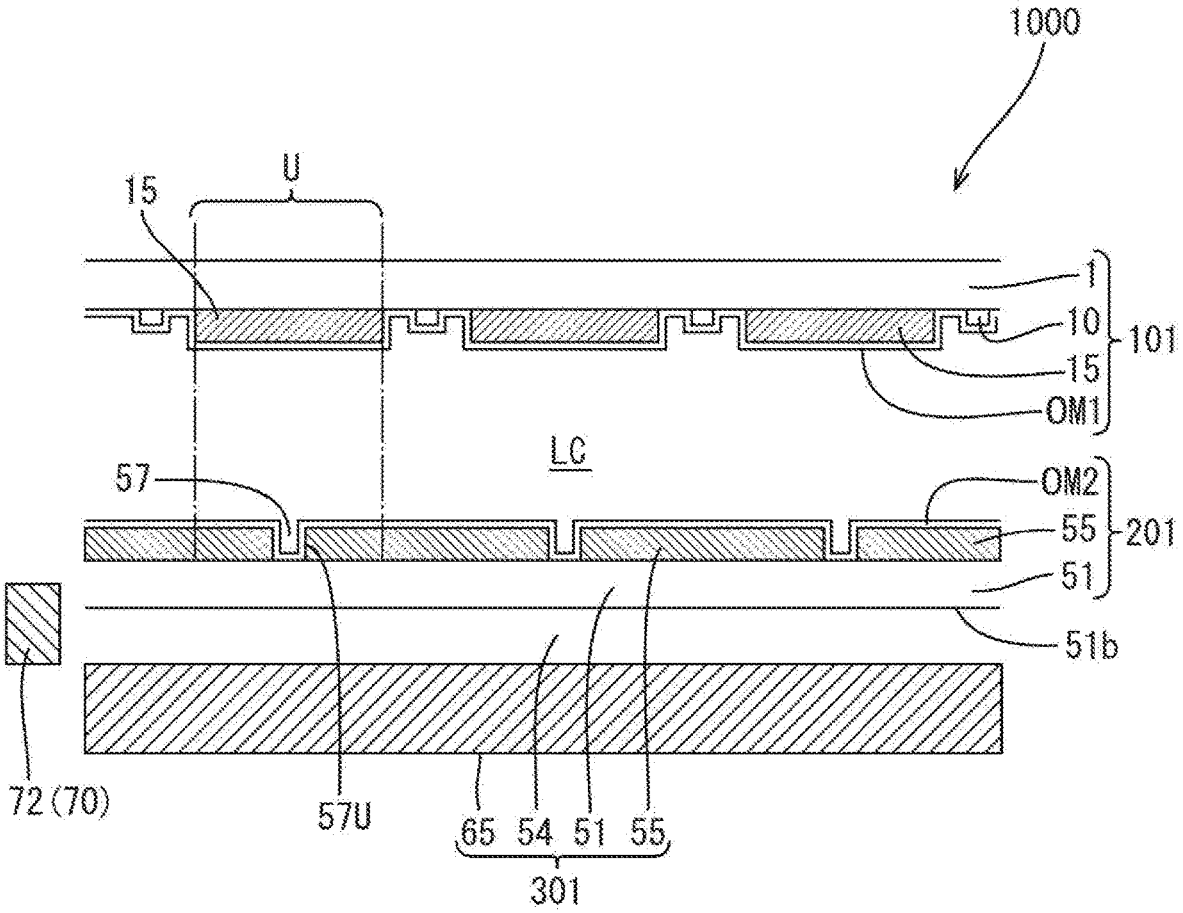
FIG. 1 is a schematic cross-sectional view of a part of a scanning antenna according to a first embodiment.

A basic structure of a scanning antenna according to an embodiment of the technology described herein will be here described with reference to FIGS. 1 to 6. FIG. 1 is a schematic cross-sectional view of a portion of a scanning antenna 1000 according to a first embodiment. The scanning antenna 1000 is a radial inline slot antenna in which slots 57 are arranged concentrically. FIG. 1 schematically illustrates a portion of a cross section along a radial direction from a power feed pin 72 provided in the vicinity of the center of the concentrically arranged slots. In another embodiment, the slots may be arrayed in various known forms (for example, spiral form and matrix form).

The scanning antenna 1000 mainly includes a TFT substrate 101, a slot substrate 201, a liquid crystal layer LC disposed therebetween, and a reflective conductive plate 65. The scanning antenna 1000 is configured to transmit and receive microwaves from the TFT substrate 101. The TFT substrate 101 and the slot substrate 201 are opposed to each other with the liquid crystal layer LC interposed therebetween.

The TFT substrate 101 includes a dielectric substrate (an example of a first dielectric substrate) 1 such as a glass substrate, a plurality of patch electrodes 15 and a plurality of thin film transistors (TFTs) 10 formed on the liquid crystal layer LC side of the dielectric substrate 1, and an acidic group-containing orientation film OM1 formed on the outermost surface on the liquid crystal layer LC side. The acidic group-containing orientation film OM1 will be described later in detail. Each of the TFTs 10 is connected to a gate bus line and a source bus line. Although the TFT 10 of the present embodiment is a channel etch type having a bottom gate structure, the TFT 10 may be a TFT of another structure in another embodiment.

The slot substrate 201 includes a dielectric substrate (an example of a second dielectric substrate) 51 such as a glass substrate, a slot electrode 55 formed on the liquid crystal layer LC side of the dielectric substrate 51, and an acidic group-containing orientation film OM2 formed on an outermost surface on the liquid crystal layer LC side. The acidic group-containing orientation film OM2 will be described later in detail. The slot electrode 55 is provided with a plurality of slots 57. The surface on the liquid crystal layer LC side of the dielectric substrate 51 will be referred to as a first main surface, and the surface on the opposite side will be referred to as a second main surface.

The reflective conductive plate 65 is opposed to the slot substrate 201 via an air layer 54. That is, the reflective conductive plate 65 is opposed to the second main surface of the dielectric substrate (an example of the second dielectric substrate) 51 of the slot substrate 201 with the air layer (dielectric layer) 54 interposed therebetween. In another embodiment, instead of the air layer 54, a layer formed of a dielectric with a small dielectric constant M with respect to microwaves (for example, a fluorine resin such as PTFE) may be used. In the scanning antenna 1000 of the present embodiment, the slot electrode 55, the reflective conductive plate 65, and the dielectric substrate 51 and the air layer 54 between them serve as a waveguide 301.

The patch electrodes 15, the portions of the slot electrode 55 including the slots 57 (hereinafter, also called "slot electrode units 57U"), and the liquid crystal layer LC between them constitute antenna units U. In each of the antenna units U, one island-shaped patch electrode 15 is opposed to one hole-shaped slot 57 (slot electrode unit 57U) with the liquid crystal layer LC therebetween, which have a liquid crystal capacitance. In this description, each of the antenna units U here includes one patch electrode 15 and the slot electrode 55 (slot electrode unit 57U) in which at least one slot 57 corresponding to the patch electrode 15 is disposed. In the scanning antenna 1000 of the present embodiment, a plurality of antenna units U is arranged concentrically. Each of the antenna units U includes an auxiliary capacitance electrically connected in parallel to the liquid crystal capacitance.

The slot electrode 55 constitutes an antenna unit U in each of the slot electrode units 57U and also serves as a wall of the waveguide 301. Therefore, the slot electrode 55 needs to have a function of suppressing the transmission of microwaves, and is made of a relatively thick metal layer. Unlike the slot electrode 55, the patch electrodes 15 do not constitute the waveguide 301, and thus the patch electrodes 15 are made of metal layers thinner than the slot electrode 55. Examples of these metal layers include a Cu layer and an Al layer.

The arrangement pitch of the antenna units U is set to $\lambda/4$ (6.25 mm) or less and/or $\lambda/5$ (5 mm) or less, for example, where $\lambda$ represents the wavelength of a microwave (for example, 25 mm).

The scanning antenna 1000 changes the phases of microwaves excited (re-radiated) from the patch electrodes 15 by changing the electrostatic capacitance values of the liquid crystal capacitances of the antenna units U. Therefore, in the liquid crystal layer LC preferably, the anisotropy ($\Delta\varepsilon_M$) of the dielectric constant M ($\varepsilon_M$) with respect to microwaves is large. For example, it is preferable to use a liquid crystal material with $\Delta\varepsilon_M$ of 15 or more. The thickness of the liquid crystal layer LC is set to 1 μm or more and 500 μm or less, for example. The liquid crystal material (liquid crystal compound) constituting the liquid crystal layer LC will be described later in detail.

Figure 2:
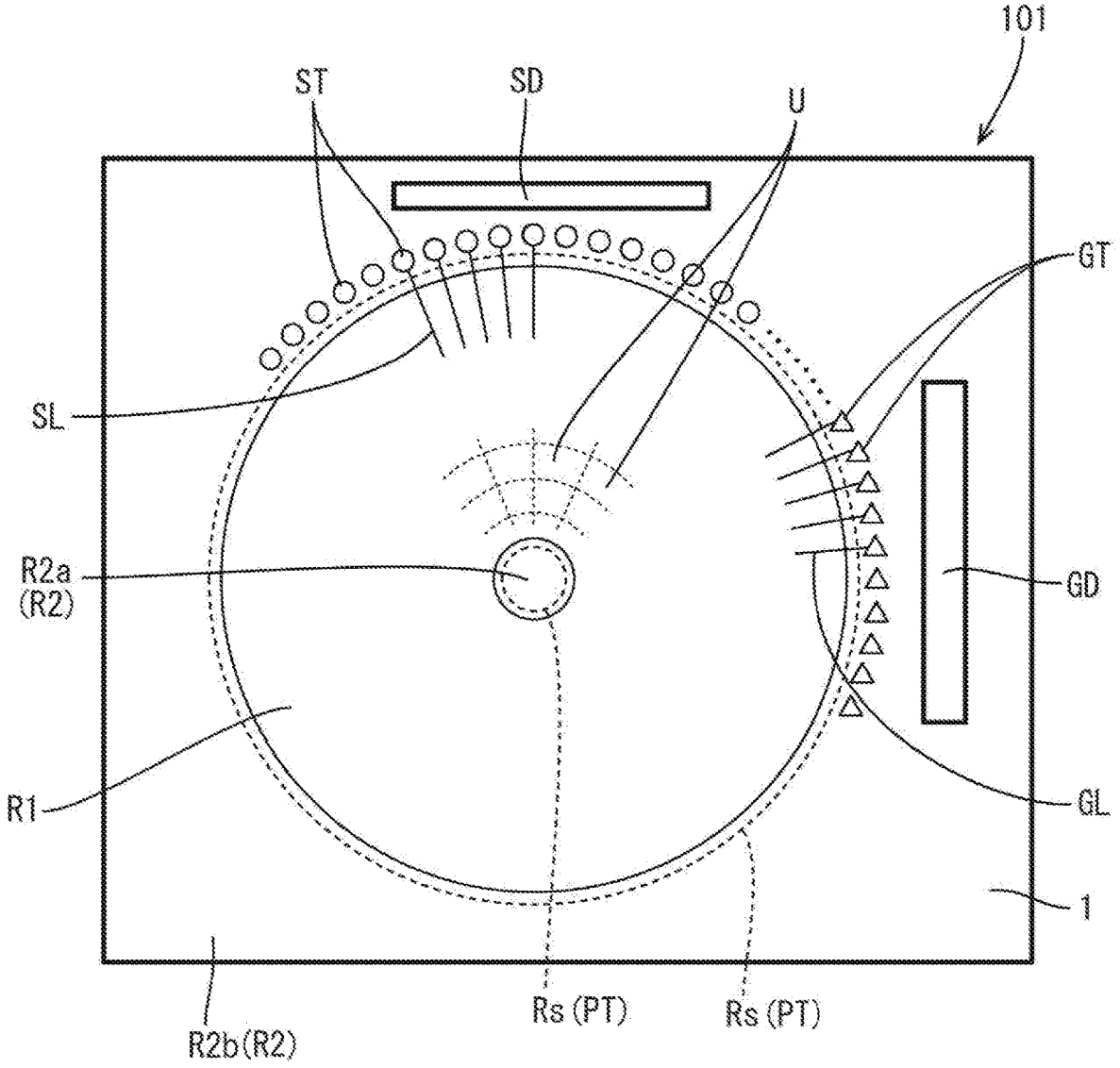
FIG. 2 is a schematic plan view of a TFT substrate provided in the scanning antenna.
Figure 3:
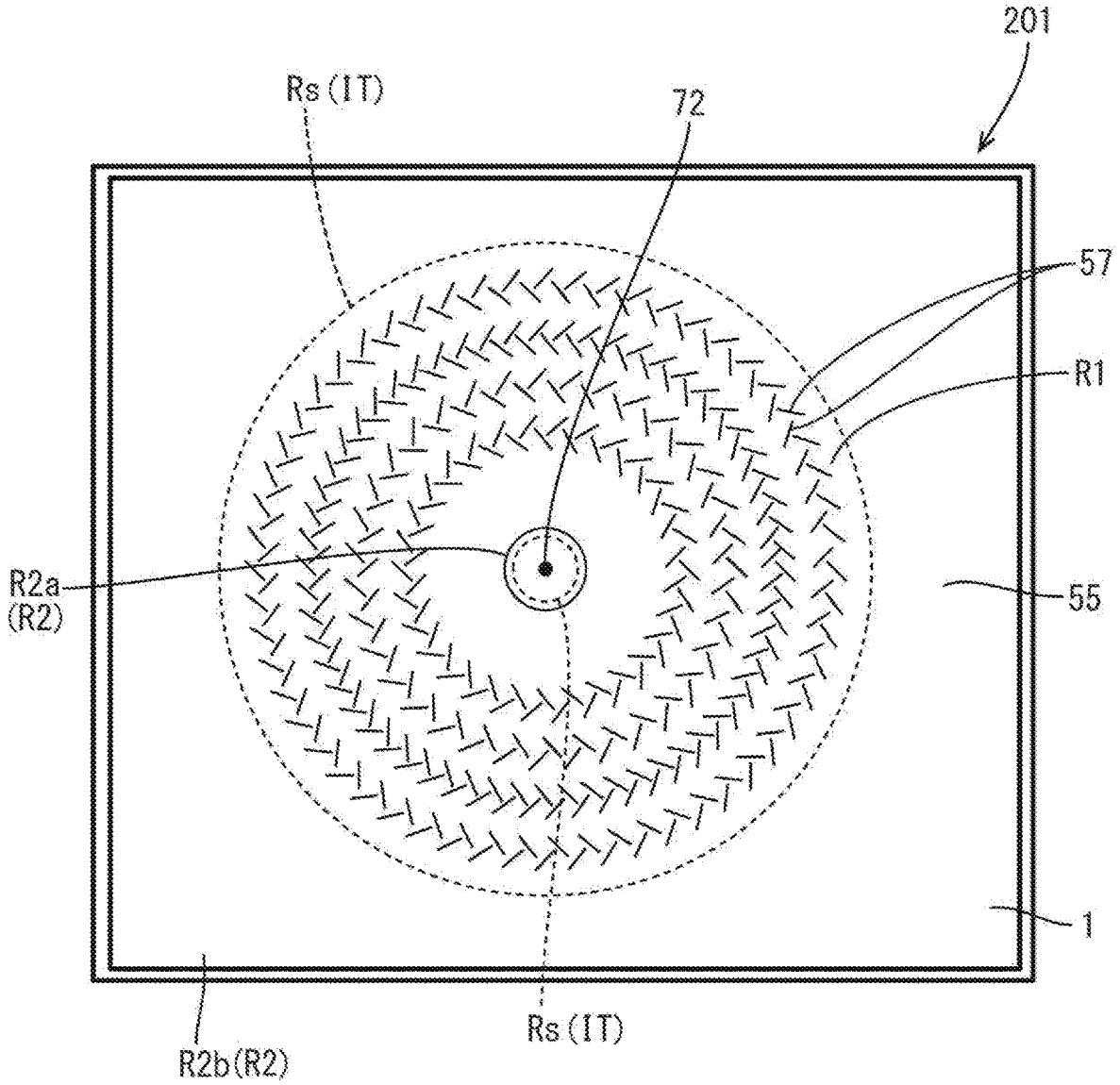
FIG. 3 is a schematic plan view of a slot substrate provided in the scanning antenna.

FIG. 2 is a schematic plan view of the TFT substrate 101 of the scanning antenna 1000, and FIG. 3 is a schematic plan view of the slot substrate 201 included in the scanning antenna 1000. The regions of the TFT substrate 101 corresponding to the antenna units U and the region of the slot substrate 201 will be both referred to as "antenna unit regions" for convenience of explanation, and the same reference symbol as that of the antenna units will be set as the reference symbol of these regions. Further, as illustrated in FIGS. 2 and 3, in the TFT substrate 101 and the slot substrate 201, a region defined by a plurality of two-dimensionally arranged antenna unit regions U will be referred to as a "transmission/reception region R1". A region other than the transmission/reception region R1 will be referred to as a "non-transmission/reception region R2". There are a terminal IT, a drive circuit, and the like disposed in the non-transmission/reception region R2.

The transmission/reception region R1 has an annular shape in a planar view. The non-transmission/reception region R2 includes a first non-transmission/reception region R2*a* located at the center of the transmission/reception region R1 and a second non-transmission/reception region R2*b* disposed in the periphery of the transmission/reception region R1. The outer diameter of the transmission/reception region R1 is 200 mm or more and 1,500 mm or less, for example, and is appropriately set according to the communication volume or the like.

A plurality of gate bus lines GL and a plurality of source bus lines SL are supported by the dielectric substrate 1 in the transmission/reception region R1 of the TFT substrate 101. Driving of each of the antenna unit regions U is controlled using these lines. Each of the antenna unit regions U includes the TFT 10 and the patch electrodes 15 electrically connected to the TFT 10. Source electrodes of the TFT 10 are electrically connected to the source bus lines SL, and data signals are supplied from the source bus lines SL. Gate electrodes of the TFT 10 are electrically connected to the gate bus lines GL, and scanning signals are supplied from the gate bus lines GL. Drain electrodes of the TFT 10 are electrically connected to the patch electrodes 15.

The gate electrodes and the gate bus lines GL may be formed of the same conducting films (gate conducting films). In addition, the source electrodes, the drain electrodes, and the source bus lines SL may be formed of the same conducting films (source conducting films).

The non-transmission/reception region R2 (the first non-transmission/reception region R2*a* and the second non-transmission/reception region R2*b*) includes a seal region Rs in which a sealant (not illustrated) is formed to surround the transmission/reception region R1. The sealant has a function of bonding the TFT substrate 101 and the slot substrate 201 to each other and sealing a liquid crystal material (liquid crystal layer LC) between the substrates 101 and 201. The sealant will be described later in detail.

Gate terminals GT, a gate driver GD, source terminals ST, and a source driver SD are disposed outside the seal region R2 in the non-transmission/reception region R2. The gate bus lines GL are connected to the gate driver GD via the gate terminals GT, and the source bus lines SL are connected to the source driver SD via the source terminals ST. In the present embodiment, both the source driver SD and the gate driver GD are formed on the dielectric substrate 1 of the TFT substrate 101. However, one or both of these drivers may be formed on the dielectric substrate 51 of the slot substrate 201.

A plurality of transfer terminals PT is provided in the non-transmission/reception region R2. The transfer terminals PT are electrically connected to the slot electrode 55 of the slot substrate 201. In the present embodiment, the transfer terminals PT are disposed in both the first non-transmission/reception region R2*a* and the second non-transmission/reception region R2*b*. In another embodiment, the transfer terminals PT may be disposed in only one of the regions. Further, in the present embodiment, the transfer terminals PT are disposed in the seal region Rs. Therefore, a conductive resin containing conductive particles (conductive beads) is used as the sealant.

As illustrated in FIG. 3, in the slot substrate 201, the slot electrode 55 is formed on the dielectric substrate 51 so as to extend over the transmission/reception region R1 and the non-transmission/reception region R2. FIG. 3 illustrates the surface of the slot substrate 201 viewed from the liquid crystal layer LC side, without the acidic group-containing orientation film OM2 formed on the outermost surface for the convenience of description.

In the transmission/reception region R1 of the slot substrate 201, the plurality of slots 57 is provided in the slot electrode 55. These slots 57 are allocated one by one to the antenna unit regions U of the TFT substrate 101. In the case of the present embodiment, the plurality of slots 57 includes pairs of slots 57 extending in directions substantially orthogonal to each other are arranged in a concentric pattern to constitute a radial in-line slot antenna. With these pairs of slots 57, the scanning antenna 1000 can transmit and receive circularly polarized waves.

A plurality of terminals IT of the slot electrode 55 is provided in the non-transmission/reception region R2 of the slot substrate 201. The terminals IT are electrically connected to the transfer terminals PT of the TFT substrate 101. In the present embodiment, the terminals IT are disposed in the seal region Rs. As described above, the terminals IT are electrically connected to the corresponding transfer terminals PT by the sealant made of the conductive resin including the conductive particles (conductive beads).

In the first non-transmission/reception region R2*a*, a power feed pin 72 is provided at the center of the concentric circles formed by the slots 57. The power feed pin 72 supplies microwaves to the waveguide 301 formed by the slot electrode 55, the reflective conductive plate 65, and the dielectric substrate 51. The power feed pin 72 is connected to a power feed device 70. The feeding method may be either a direct feeding method or an electromagnetic coupling method, and a known feeding structure can be adopted.

Examples of the gate conductive film and the source conductive film include metals such as aluminum (Al), tungsten (W), molybdenum (Mo), tantalum (Ta), chromium (Cr), titanium (Ti), and copper (Cu), and alloys of these metals. Alternatively, films containing the metal nitrides of these metals can be used as appropriate.

The waveguide 301 is configured such that the reflective conductive plate 65 is opposed to the slot electrode 55 with the dielectric substrate 51 therebetween. The reflective conductive plate 65 is disposed to face the back surface of the dielectric substrate 51 with the air layer 54 interposed therebetween. To form the wall of the waveguide 301, the reflective conductive plate 65 preferably has a thickness three or more times, preferably five or more times the skin depth. The reflective conductive plate 65 can be an aluminum plate or a copper plate produced by shaving with a thickness of several mm, for example.

For example, at the time of transmission from the scanning antenna 1000, the waveguide 301 guides a microwave supplied from the power feed pin 72 at the center of the plurality of antenna units U arranged in a concentric pattern, in such a manner as to radially spread toward the outside. While moving in the waveguide 301, the microwave is cut off at each of the slots 57 in each of the antenna units U to generate an electric field according to the principle of a slot antenna. By the action of the electric field, electric charge is induced in the slot electrode 55 (that is, the microwave is converted to the vibrations of free electrons in the slot electrode 55). In each of the antenna units U, by changing the electrostatic capacitance value of the liquid crystal capacitance through the orientation control of the liquid crystal, the phase of vibrations of the free electrons induced in the patch electrode 15 is controlled. When electric charge is induced in the patch electrode 15, an electric field is generated (that is, the vibrations of free electrons in the slot electrode 55 move to the vibrations of free electrons in the patch electrode 15), such that a microwave (radio wave) is emitted from the patch electrode 15 in each of the antenna units U to the outside of the TFT substrate 101. By adding up the microwaves (radio waves) of different phases emitted from the antenna units U, the azimuth angle of the beam is controlled.

In another embodiment, the waveguide may have a two-layer structure of upper and lower layers. In this case, the microwave supplied from the power feed pin first moves in the lower layer radially from the center to the outside, then rises to the upper layer from the outer wall portion of the lower layer, and then moves in the upper layer from the outside to the center. With such a two-layer structure, the waveguide can easily distribute a microwave to the antenna units U in a uniform manner.

Figure 4:
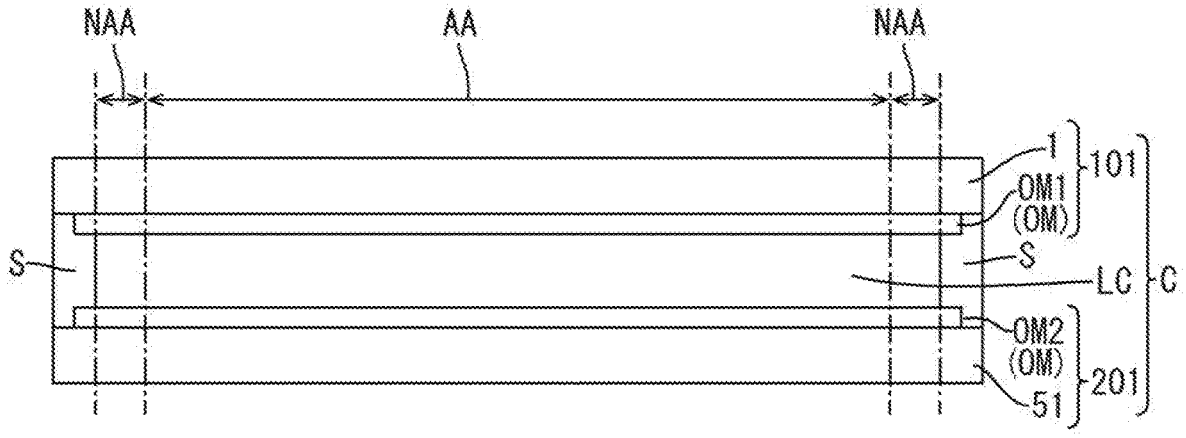
FIG. 4 is a schematic cross-sectional view of a configuration of a liquid crystal cell.

FIG. 4 is a schematic cross-sectional view of a configuration of a liquid crystal cell C. Between the TFT substrate 101 and the slot substrate 201, which is a pair of substrates constituting the liquid crystal cell C, a frame-shaped sealant S is disposed to surround the liquid crystal layer LC. The sealant S adheres to the TFT substrate 101 and the slot substrate 201, and has a function of bonding the TFT substrate 101 and the slot substrate 201 to each other. The TFT substrate 101 and the slot substrate 201 form a pair of substrates facing each other with the liquid crystal layer LC interposed therebetween.

There is no particular limitation on liquid crystal material (liquid crystal compound) for the liquid crystal layer LC as long as the liquid crystal material has a large dielectric anisotropy (Δε) and does not impair the object of the technology described herein. For example, a liquid crystal material with a dielectric anisotropy (Δε) of 15 or more is used. As such a liquid crystal material, for example, an isothiocyanate group-containing liquid crystal compound is used. As the isothiocyanate group-containing liquid crystal compound, for example, compounds represented by the following chemical formula (1-1) and chemical formula (1-2) are used.

[Chemical formula 1]

(1-1)

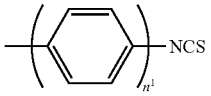

(1-2)

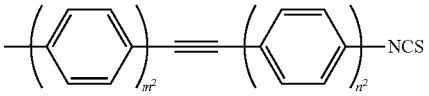

In the above chemical formula (1-1) and chemical formula (1-2), $n^1$, $m^2$ and $n^2$ are each an integer of 1 to 5, and H in the phenylene group may be substituted by F or Cl.

The liquid crystal material may include liquid crystal compounds other than the isothiocyanate group-containing liquid crystal compound as long as the compounds do not impair the object of the technology described herein.

(Acidic Group-Containing Orientation Film OM (OM1, OM2))

Acidic group-containing orientation films OM1 and OM2 (hereinafter, they will be collectively referred to as "acidic group-containing orientation film OM") are formed on the surfaces of the TFT substrate 101 and the slot substrate 201 on the liquid crystal layer LC side in the present embodiment. The acidic group-containing orientation film OM is made of a polymer film containing a polymer having an acidic group. Examples of the acidic group include a carboxyl group and a hydroxyl group.

There is no particular limitation on the polymer having an acidic group as long as the polymer does not impair the object of the technology described herein. Examples of the polymer include acrylic polymers having an acidic group and polyimide polymers having an acidic group.

The acrylic polymers having an acidic group include, for example, an acrylic polymer having a carboxyl group, an acrylic polymer having a hydroxyl group, and a polymer of an acidic group containing monomer such as a carboxyl group-containing monomer or a hydroxyl group-containing monomer. Examples of the carboxyl group-containing monomer include (meth)acrylic acid, itaconic acid, maleic acid, fumaric acid, crotonic acid, isocrotonic acid, and acid anhydrides thereof. Examples of the hydroxyl group-containing monomer include 2-hydroxyethyl (meth)acrylate, 3-hydroxypropyl (meth)acrylate, 4-hydroxybutyl (meth) acrylate, 6-hydroxyhexyl (meth)acrylate, and vinyl alcohol, allyl alcohol, and the like. These acidic group-containing monomers may be used alone or in combination of two or more. The acrylic polymer having an acidic group may include a configuration derived from a monomer other than acidic group-containing monomers as long as the acrylic polymer does not impair the object of the technology described herein. In this description, "(meth)acrylic" means "acrylic" and/or "methacrylic" (one or both of "acrylic" and "methacrylic").

The polyimide polymer having an acidic group is obtained by imidizing a polyamic acid which is a polymer of tetracarboxylic dianhydride and diamine. The imidization ratio of the polyamic acid is usually about 70 to 90%, not 100%. Therefore, the polyimide polymer contains a carboxyl group derived from an amic acid. There is no particular limitation on the tetracarboxylic acid dianhydride and the diamine as long as they do not impair the object of the technology described herein.

The polymer film constituting the acidic group-containing orientation film OM may be subjected to orientation processing such as rubbing process. However, as described later, the acidic group-containing orientation film OM (in particular, the acidic group-containing orientation film OM formed in the non-active area NAA) is preferably in a non-orientation state where the rubbing process is not performed.

The acidic group-containing orientation film OM of the present embodiment is formed to overlap the non-active area NAA as a frame-shaped area along the inner peripheral edge of the sealant S and the active area AA as an area located closer to the central side than the non-active area NAA. The active area AA is an area in which the patch electrodes 15 and the slot electrodes 55 constituting the antenna units U are arranged, and the non-active area NAA is an area in which the patch electrodes 15 and the slot electrodes 55 constituting the antenna units U are not arranged.

The acidic group-containing orientation film OM of the present embodiment is formed in both the active area AA and the non-active area NAA. However, in another embodiment, the acidic group-containing orientation film OM may be formed only in the non-active area NAA, and an orientation film not containing an acidic group may be formed in the active area AA. The acidic group-containing orientation film OM is formed at least in the non-active area NAA.

Further, the acidic group-containing orientation film OM of the present embodiment is formed on the surfaces of the TFT substrate 101 and the slot substrate 201. However, the acidic group-containing orientation film OM may be formed on at least the surface of one of the TFT substrate 101 and the slot substrate 201 as long as the film does not impair the object of the technology described herein. The acidic group-containing orientation film OM is appropriately formed by a known film forming method.

In addition, the acidic group-containing orientation film is preferably formed in a region of the non-active area NAA at least between an injection port of a liquid crystal material described later and the active area AA.

The sealant S is made of a cured product of a sealant composition containing a curable resin. The sealant composition is basically a non-solvent type. As the curable resin, a photo-curable resin that cures with light (for example, ultraviolet light, visible light, etc.) and/or a heat-curable resin that cures with heat is used. The type of the sealant S is appropriately selected according to the injection method of a liquid crystal material. For example, in the case of injecting a liquid crystal material into the liquid crystal cell C by a vacuum injection method, a photo-curable resin or a heat-curable resin is used as the curable resin.

Figure 5:
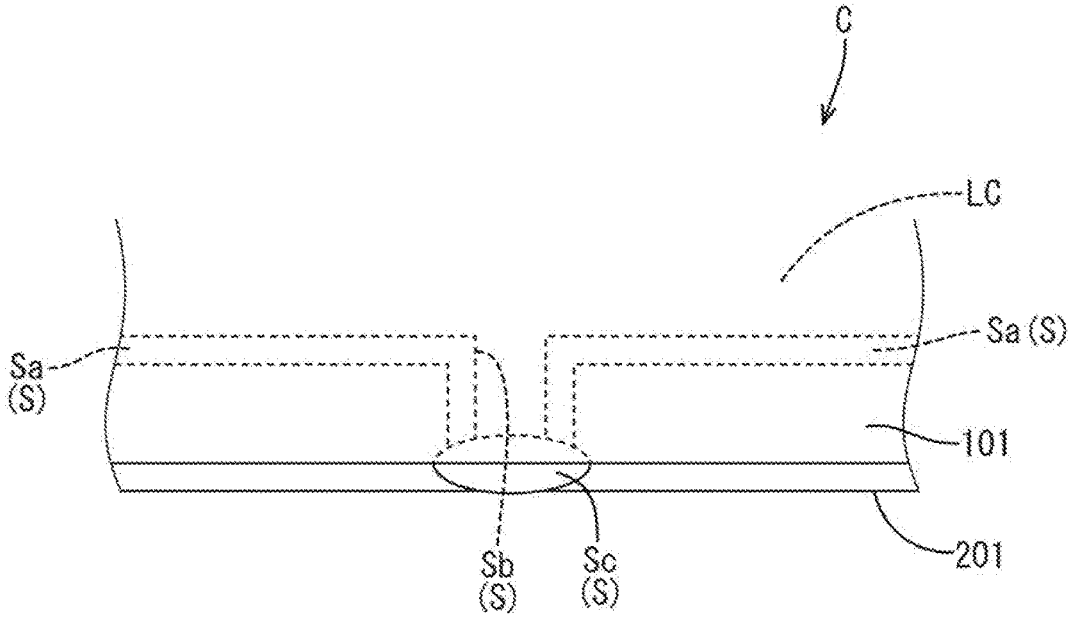
FIG. 5 is a schematic enlarged view of an injection port and a sealing portion and its vicinity of the liquid crystal cell in which a liquid crystal material is injected by a vacuum injection method.

In the case of injecting a liquid crystal material into the liquid crystal cell C by a vacuum injection method, the sealant S is provided in advance with an injection port Sb including a hole to be used when the liquid crystal material is injected as illustrated in FIG. 5. The injection port Sb is formed in a part of the sealant S to communicate with the outside and the liquid crystal layer LC side. The sealant S to be used by the vacuum injection method includes a seal main body Sa that includes the injection port Sb and surrounds the liquid crystal layer LC. After the liquid crystal material is injected into the space inside the seal main body Sa through the injection port Sb, the hole of the injection port Sb is sealed by a sealing material. A portion of the sealing material that seals the injection port Sb will be particularly referred to as a sealing portion Sc. In this description, the sealing portion Sc constitutes a part of the sealant S surrounding the liquid crystal layer LC.

In the case of injecting the liquid crystal material into the liquid crystal cell C by a one drop filling method (ODF method), a curable resin having a photo-curable property and a heat-curable property is used as the curable resin due to the ease of control of curing in two stages of temporary curing and full curing. Examples of such a curable resin include a mixture of an epoxy resin and an acrylic resin.

(Method for Manufacturing the Scanning Antenna)

A method for manufacturing the scanning antenna (a method for manufacturing the liquid crystal cell C) includes a step of bonding the TFT substrate 101 and the slot substrate 201 to each other with the sealant S therebetween and injecting a liquid crystal material into between the TFT substrate 101 and the slot substrate 201. Examples of a method for injecting a liquid crystal material include a one drop filling method (ODF method) and a vacuum injection method. Hereinafter, a method for manufacturing the liquid crystal cell C by vacuum injection will be described.

First, a sealant composition for vacuum injection is applied to one of the prepared TFT substrate 101 and the slot substrate 201 (here, the TFT substrate 101) using a sealing plate or the like. At this time, the sealant composition is applied to the substrate in a predetermined pattern to form the seal main body Sa and the injection port Sb. The portion for forming the injection port Sb is shaped such that the frame-shaped sealant composition appears to be partially cut away. The sealant composition contains a thermosetting epoxy resin and the like, for example.

Next, the sealant composition on the substrate is heated and temporarily cured. Then, the substrate (the TFT substrate 101) and the other substrate (the slot substrate 201) are bonded to each other in such a manner as to sandwich the temporarily cured sealant composition. After that, the sealant composition is heated and fully cured. At this time, the sealant composition is fully cured to form the seal main body Sa and the injection port Sb.

Subsequently, a liquid crystal material (including a thioisocyanate group-containing liquid crystal compound) is injected by an in-vacuum injection method into the liquid crystal cell C through the injection port Sb under reduced pressure. Thereafter, under normal pressure, the sealing material composition is applied to close the injection port Sb. The sealing material composition contains an adhesive component made of a curable resin for sealing the injection port Sb. Then, the sealing material composition is cured by heat or light (such as visible light), and the sealing material composition becomes the sealing portion Sc. Thus, the sealant S including the seal main body Sa, the injection port Sb, and the sealing portion Sc is formed. As above, the liquid crystal cell C can be manufactured by an in-vacuum injection method.

After the liquid crystal cell C is manufactured by an in-vacuum injection method or the like as described above, the reflective conductive plate 65 is assembled on the cell side in such a manner as to face the opposite surface of the slot substrate 201 (the second dielectric substrate 51) with the dielectric (air layer) 54 therebetween. Through these steps, the scanning antenna of the present embodiment is manufactured.

As described above, the liquid crystal cell C for scanning antenna of the present embodiment includes the acidic group-containing orientation film OM. Accordingly, even if ionic impurities are dissolved from the sealant S and the sealing portion Sc (the cured product of the sealing material composition) provided in the sealant S for sealing the injection port Sb into the liquid crystal layer LC, the acidic group-containing orientation film OM can capture the impurities. This suppresses floating of the impurities in the liquid crystal layer LC that would cause a decrease in the voltage holding ratio of the liquid crystal cell C. The ionic impurities are particularly likely to move from the vicinity of the injection port Sb (sealing portion Sc) of the sealant S into the liquid crystal layer LC. Thus, trapping of the impurities by the acidic group-containing orientation film OM is particularly effective in the liquid crystal cell C manufactured by a vacuum injection method. Therefore, the acidic group-containing orientation film OM is preferably formed in particular in the non-active area NAA between the injection port Sb (sealing portion Sc) of the sealant S and the active area AA.

EXAMPLES

Hereinafter, the technology described herein will be described in more detail based on examples. The technology described herein is not limited at all by these examples.

First Example (Preparation of a Liquid Crystal Cell for Test)

Figure 6:
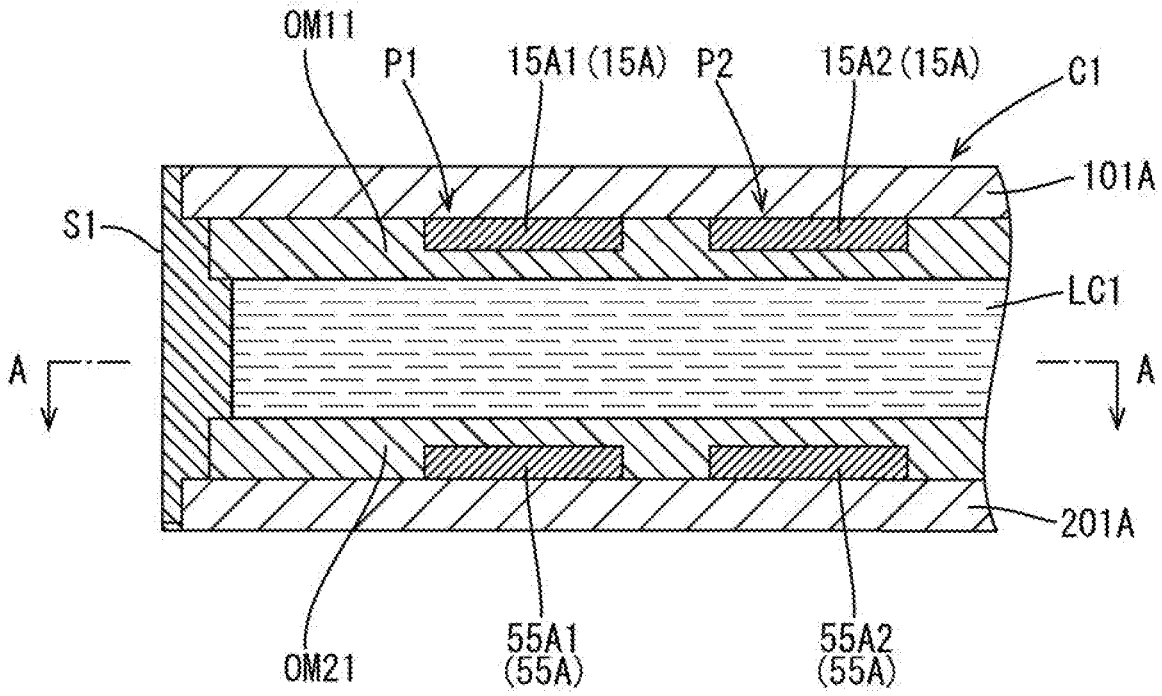
FIG. 6 is an explanatory diagram schematically illustrating a cross-sectional configuration of a part of a liquid crystal cell according to a first example.
Figure 7:
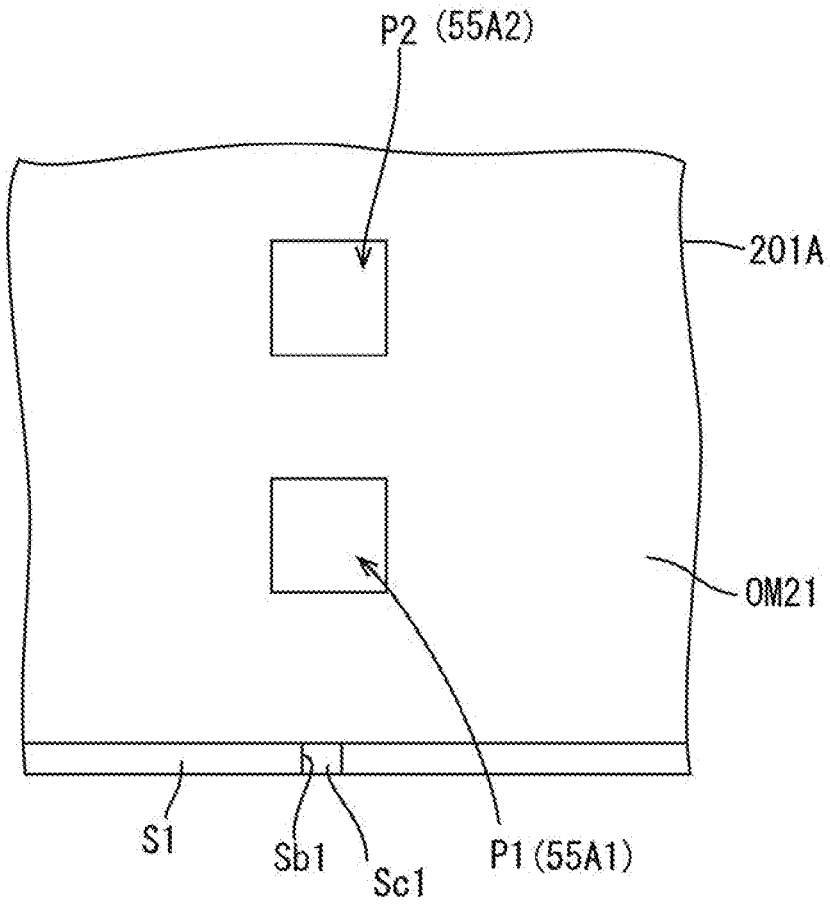
FIG. 7 is a cross-sectional view of FIG. 6 taken along line A-A.

FIG. 6 is an explanatory diagram schematically illustrating a partial cross-sectional configuration of a liquid crystal cell C1 according to a first example. FIG. 7 is an explanatory diagram schematically illustrating a partial plane configuration of the liquid crystal cell C1 according to the first example. The liquid crystal cell C1 for test of the first example was produced by the method described below.

First, a TFT substrate 101A without an acidic group-containing orientation film OM11 that is identical in basic configuration to the TFT substrate 101 and a slot substrate 201A without an acidic group-containing orientation film OM21 that is identical in basic configuration to the slot substrate 201 were prepared. First electrodes 15A of the TFT substrate 101A corresponding to the patch electrodes and second electrodes 55A of the slot substrate 201A corresponding to the slot electrodes were formed of indium tin oxide (ITO). Then, the acidic group-containing orientation films OM11 and OM21 described later were respectively formed on the surfaces of the TFT substrate 101A and the slot substrate 201A. The thickness (film thickness) of each of the acidic group-containing orientation films OM11 and OM21 is 100 nm.

The acidic group-containing orientation films OM11 and OM21 are both made of a polymer film containing a polymethacrylic acid (an example of an acrylic polymer having a carboxyl group as an acidic group). As an orientation agent for forming the acidic group-containing orientation films OM11 and OM21, a solution was prepared by dissolving the polymethacrylic acid in a predetermined solvent. The solution was applied to the surfaces of the TFT substrate 101A and the slot substrate 201A by spin coating. Then, the coated film on each of the surfaces was heated (temporarily dried) at a temperature of 60° C. for 90 seconds using a hot plate, and then baked at a temperature of 150° C. for 20 minutes. Thereafter, the coating films were subjected to a rubbing process to form the acidic group-containing orientation films OM11 and OM21 on the surfaces of the TFT substrate 101A and the slot substrate 201A.

Next, a heat-curable sealant composition (product name "HC1413FP", produced by Mitsui Chemicals, Inc.) drawn in a frame shape was printed using a screen plate on the surface of the TFT substrate 101A (on the acidic group-containing orientation film OM11 side). In addition, beads with a particle diameter of 3.5 μm (product name "PF-35S, produced by Nippon Electric Glass Co., Ltd.) were dispersed as spacers on the surface of the slot substrate 201A (on the acidic group-containing orientation film OM21 side). The slot substrate 201A was bonded to the TFT substrate 101A with the sealant composition therebetween. Thereafter, while being pressurized under the condition of 0.5 kgf/cm$^2$, the bonded TFT substrate 101A and slot substrate 201A were heated at a temperature of 130° C. for 60 minutes in a heating furnace having undergone a nitrogen purge, thereby obtaining a sealant S1 made of a cured product of the sealant composition. The sealant S1 is provided with an injection port Sb1 for injecting a liquid crystal material. In this manner, a cell (empty cell) not filled with the liquid crystal material was obtained.

A liquid crystal material ($\Delta\varepsilon$=15) containing an isothiocyanate group-containing liquid crystal compound was injected into the cell under vacuum using the injection port. After the injection, a sealing material composition made of an ultraviolet curable resin (product name "TB3026E", produced by Three Bond Co., Ltd.) was applied to close the injection port, and the sealing material composition was cured to seal the injection port. The sealing material composition was cured by irradiation with ultraviolet light (wavelength: 365 nm). Thereafter, the first electrodes 15A and the second electrodes 55A facing each other were short-circuited and heated at a temperature of 100° C. for 10 minutes to obtain the liquid crystal cell C1 of the first example.

For convenience of explanation, as illustrated in FIG. 6, the first electrode 15A closer to the sealant S1 will be referred to as "first electrode 15A1", and the first electrode 15A farther from the sealant S1 will be referred to as "first electrode 15A2". Further, the second electrode 55A closer to the sealant S1 will be referred to as "second electrode 55A1", and the second electrode 55A farther from the sealant S1 will be referred to as "second electrode 55A2". The first electrode 15A1 and the second electrode 55A1 facing each other will be referred to as "first electrode pair P1", and the first electrode 15A2 and the second electrode 55A2 facing each other will be referred to as "second electrode pair P2". Further, as illustrated in FIG. 7, the sealant S1 is provided with the injection port Sb1 that is closed by the sealing portion Sc1 made of a cured product of the sealing material composition.

(Evaluation of Voltage Holding Ratio)

The liquid crystal cell of the first example was left (aged) for 1000 hours in a thermostatic bath (product name "MC-771T", produced by ESPEC Corp.) set at 95° C. After that, the voltage holding ratios (VHRs) of the first electrode pair P1 and the second electrode pair P2 of the liquid crystal cell were measured. The measurement of the voltage holding ratios was performed using a Model 6254 VHR measurement system (manufactured by Toyo Corporation), under the conditions that the applied voltage was 10V, the holding time was 16.67 ms, and the measurement temperature was 70° C. As a result, the voltage holding ratio of the first electrode pair P1 close to the sealant S1 was 40%, and the voltage holding ratio of the second electrode pair P2 far from the sealant S1 was 55%.

Figure 8:
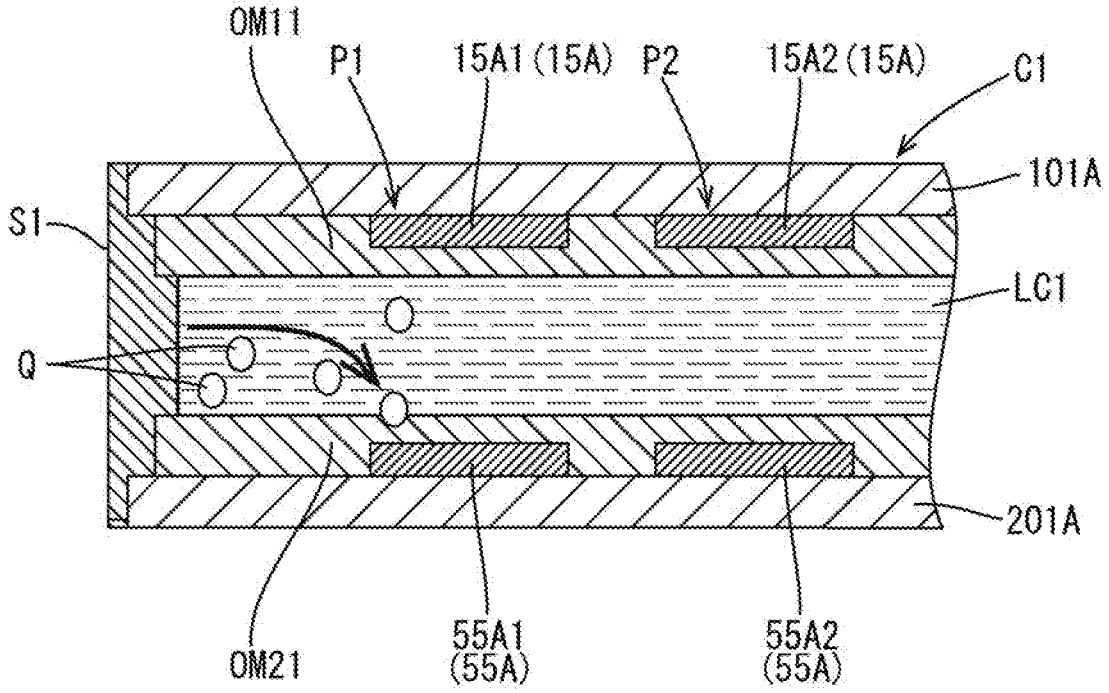
FIG. 8 is an explanatory diagram schematically illustrating the liquid crystal cell in the first example in which ionic impurities dissolved from the sealant is adsorbed by an acidic group-containing orientation film.

FIG. 8 is an explanatory diagram schematically illustrating the liquid crystal cell C1 in the first example in which ionic impurities Q dissolved from the sealant S1 is adsorbed by the acidic group-containing orientation film OM21. As illustrated in FIG. 8, when the liquid crystal cell C1 is continuously used, the ionic impurities Q are dissolved from the sealant S1 and the sealing material (sealing portion) sealing the injection port into the liquid crystal layer LC1. Since the liquid crystal layer LC1 has high dielectric anisotropy, the ionic impurities Q are easy to dissolve. However, since the acidic group-containing orientation films OM11 and OM21 have a carboxyl group as an acidic group, the impurities Q can be captured by the acidic group. FIG. 8 illustrates a state in which the impurities Q are trapped in the acidic group-containing orientation film OM21 for convenience of explanation. As a matter of the course, the impurities Q can be trapped also by the acidic group-containing orientation film OM11. The impurities Q dissolved from the sealant S1 and the like are supposed to be immediately captured by the acidic group-containing orientation films OM11 and OM21. Therefore, it is assumed that the second electrode pair P2 far from the sealant S1 is less affected by the impurities Q than the first electrode pair P1 close to the sealant S1, and is higher in the value of the voltage holding ratio as described above.

First Comparative Example

Figure 9:
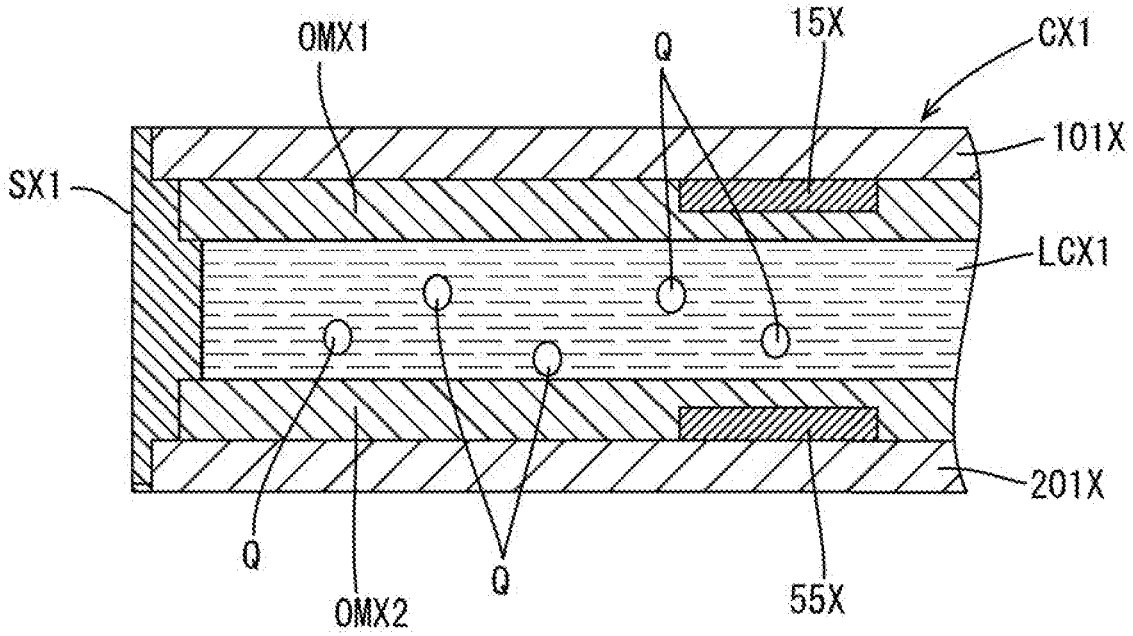
FIG. 9 is an explanatory diagram schematically illustrating a partial cross-sectional configuration of a liquid crystal cell according to a first comparative example.

FIG. 9 is an explanatory diagram schematically illustrating a partial cross-sectional configuration of a liquid crystal cell CX1 according to a first comparative example. The configuration of the liquid crystal cell CX1 of the first comparative example is basically the same as that of the liquid crystal cell C1 of the first example, except for the orientation film. In the liquid crystal cell CX1 of the first comparative example, both an orientation film OMX1 on a TFT substrate 101X1 and an orientation film OMX2 of a slot substrate 201X1 are made of a polymer film containing polymethyl methacrylate. The liquid crystal cell CX1 of the first comparative example was produced in the same manner as in the first example except that a solution containing polymethyl methacrylate was used as an orientation agent for forming the acidic group-containing orientation films OMX1 and OMX2.

As illustrated in FIG. 9, in the liquid crystal cell CX1 of the first comparative example, first electrodes 15X of the TFT substrate 101X corresponding to the patch electrodes and second electrodes 55X of the slot substrate 201X corresponding to the slot electrodes face each other with a liquid crystal layer LCX1 therebetween. The voltage holding ratio of the liquid crystal cell CX1 of the first comparative example was evaluated in the same manner as in the first example. As a result, the voltage holding ratio of the first comparative example was 20%. As illustrated in FIG. 9, when the liquid crystal cell CX1 is continuously used, ionic impurities Q are supposed to be dissolved in the liquid crystal layer LCX1 from a sealant SX1 or the like as in the first example. However, in the first comparative example, the polymer constituting the orientation films OMX1 and OMX2 does not have an acidic group, the orientation films OMX1 and OMX2 cannot capture the impurities Q. Therefore, it is assumed that, in the first comparative example, the voltage holding ratio is lowered due to the influence of the impurities Q floating in the liquid crystal layer LCX1.

Second Example

A liquid crystal cell of a second example having the same configuration as the liquid crystal cell C1 of the first example except for the orientation film was produced. In the liquid crystal cell of the second example, an acidic group-containing orientation film made of a polymer film containing poly(2-hydroxyethyl methacrylate) (an example of an acrylic polymer having a hydroxyl group as an acidic group) were formed on each surface of a TFT substrate and a slot substrate. In the second example, a solution was prepared by dissolving polyhydroxyethyl methacrylate in a predetermined solvent as an orientation agent. Using the solution, an acidic group-containing orientation film was formed on the surfaces of the TFT substrate and the slot substrate in the same manner as in the first example. As with the first example, the liquid crystal cell of the second example also includes a first electrode pair close to the sealant and a second electrode pair far from the sealant.

The voltage holding ratio of the liquid crystal cell of the second example was evaluated in the same manner as in the first example. As a result, the voltage holding ratio of the first electrode pair close to the sealant was 60%, and the voltage holding ratio of the second electrode pair far from the sealant was 80%. As described above, also in the liquid crystal cell of the second example, ionic impurities are captured by the acidic group-containing orientation film in the same manner as in the first example, and therefore the influence of the impurities (decrease in the voltage holding ratio) is suppressed. Further, as in the first example, it was confirmed in the second example that the second electrode pair far from the sealant was less affected by impurities than the first electrode pair close to the sealant.

Third Example

A liquid crystal cell of a third example having the same configuration as the liquid crystal cell C1 of the first example except for the orientation film was produced. In the liquid crystal cell of the third example, an acidic group-containing orientation film made of a polymer film containing a polyimide polymer represented by the following chemical formula (2) (an example of a polyimide polymer having a carboxyl group as an acidic group) was formed on each surface of a TFT substrate and a slot substrate. In chemical formula (2), n is an arbitrary positive integer.

[Chemical formula 2]

(2)

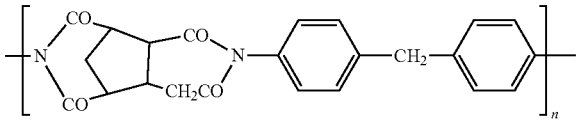

In the third example, a solution in which a polyamic acid represented by the following chemical formula (3) was dissolved in a predetermined solvent was used as an orientation agent.

[Chemical 3]

(3)

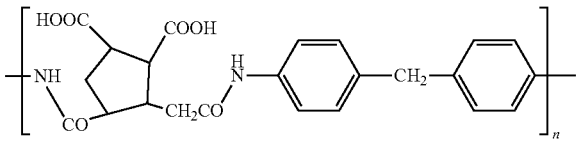

The solution was applied to the surfaces of the TFT substrate and the slot substrate by spin coating. Thereafter, the coating film on the surfaces was baked at a temperature of 200° C. using a hot plate to imidize the polyamic acid. Thereafter, each coating film was subjected to a rubbing process, and then the coating films having undergone the rubbing process was washed with pure water and further heated at 130° C. for 30 minutes for drying. In this manner, the acidic group-containing orientation film made of a polymer film containing a polyimide polymer represented by the chemical formula (2) was formed on the surfaces of the TFT substrate and the slot substrate.

The imidization ratio of the polyimide polymer represented by the chemical formula (2) is not 100%, but is about 70 to 90%, and the polyimide polymer has an amic acid partially remained. Therefore, the polyimide polymer contains a carboxyl group derived from the amic acid. As with the first example, the liquid crystal cell of the third example includes a first electrode pair close to the sealant and a second electrode pair far from the sealant.

The voltage holding ratio of the liquid crystal cell of the third example was evaluated in the same manner as in the first example. As a result, the voltage holding ratio of the first electrode pair close to the sealant was 75%, and the voltage holding ratio of the second electrode pair far from the sealant was 85%. As above, also in the liquid crystal cell of the third example, the influence of impurities (decrease in the voltage holding ratio) is suppressed. Since the orientation film of the third example contains a carboxyl group derived from an amic acid, the polarity becomes high to facilitate adsorption of ionic impurities. Further, as in the first example, it was confirmed in the third example that the second electrode pair far from the sealant was less affected by impurities than the first electrode pair close to the sealant.

Fourth Example

Figure 10:
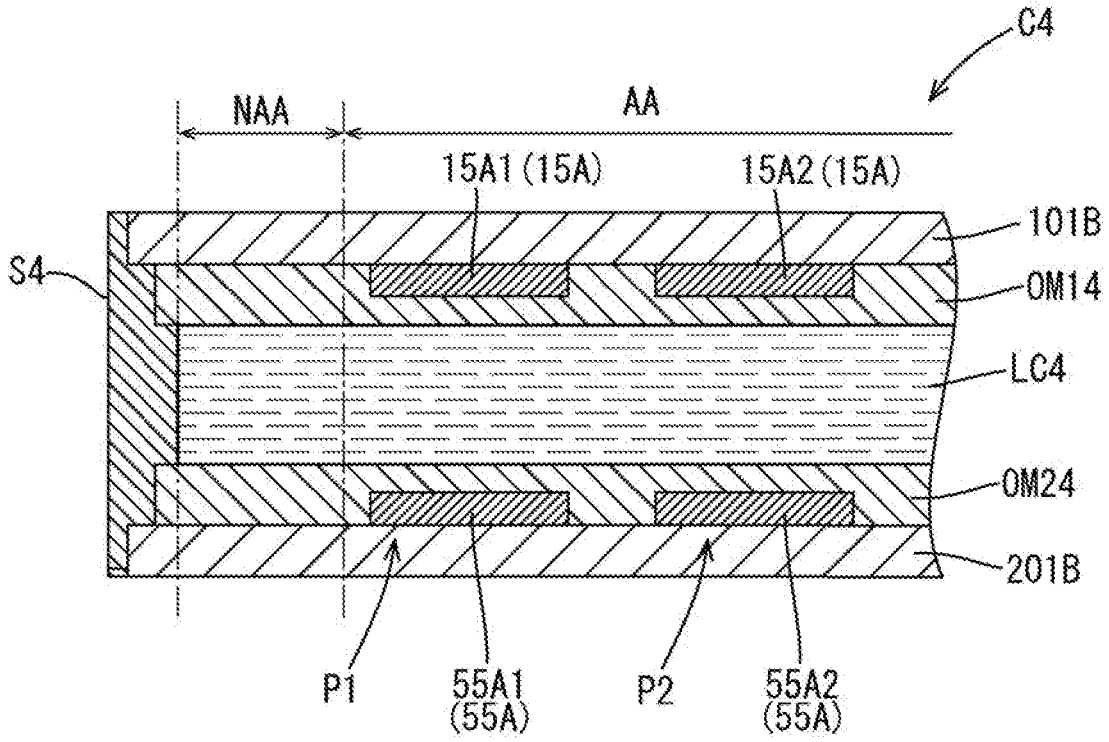
FIG. 10 is an explanatory diagram schematically illustrating a partial cross-sectional configuration of a liquid crystal cell according to a fourth example.

FIG. 10 is an explanatory diagram schematically illustrating a partial cross-sectional configuration of a liquid crystal cell C4 according to a fourth example. The liquid crystal cell C4 of the fourth example is the same in configuration as the liquid crystal cell of the third example except for the orientation film. The liquid crystal cell C4 of the fourth example was produced by the same method as that of the third example except that the processes after the rubbing process were not performed at the formation of the orientation film. Specifically, in the liquid crystal cell C4 of the fourth example, acidic group-containing orientation films OM14 and OM24 that are in a non-orientation state where no orientation processing is performed and are made of polymer films containing a polyimide polymer having a carboxyl group as an acidic group, were formed on each surface of a TFT substrate 101B and a slot substrate 201B. As with the first example and others, the liquid crystal cell C4 of the fourth example includes a first electrode pair P1 close to a sealant S4 and a second electrode pair P2 far from the sealant S4.

The voltage holding ratio of the liquid crystal cell C4 of the fourth example was evaluated in the same manner as in the first example. As a result, the voltage holding ratio of the first electrode pair P1 close to the sealant S4 was 75%, and the voltage holding ratio of the second electrode pair P2 far from the sealant S4 was 90%.

As illustrated in FIG. 10, the liquid crystal cell C4 includes a non-active area NAA formed of an area along the inner peripheral edge of the sealant S4 and an active area AA formed of an area located closer to the central side than the non-active area NAA. The non-active area NAA is entirely in the form of a frame along the inner peripheral edge of the frame-shaped sealant S4. The first electrode pair P1 and the second electrode pair P2 are disposed in the active area AA. The first electrode pair P1 includes a first electrode 15A1 (15A) corresponding to a patch electrode and a second electrode 55A1 (55A) corresponding to a slot electrode, which constitutes an antenna unit. The second electrode pair P2 includes a first electrode 15A2 (15A) corresponding to a patch electrode and a second electrode 55A2 (55A) corresponding to a slot electrode, which constitutes an antenna unit.

As in the present example, by setting the acidic group-containing orientation films OM14 and OM24 in a non-orientation state in the area from the sealant S4 to the active area AA (the non-active area NAA), the directors of liquid crystal molecules are oriented at random. Therefore, the mobility of ions is more limited than in the state where liquid crystal molecules are oriented uniformly. Therefore, ionic impurities dissolved from the sealant S4 and the like are easily captured by the acidic group-containing orientation films OM14 and OM24 in the non-active area. As a result, in the active area AA, the voltage holding ratio is less likely to decrease.

Fifth Example

Figure 11:
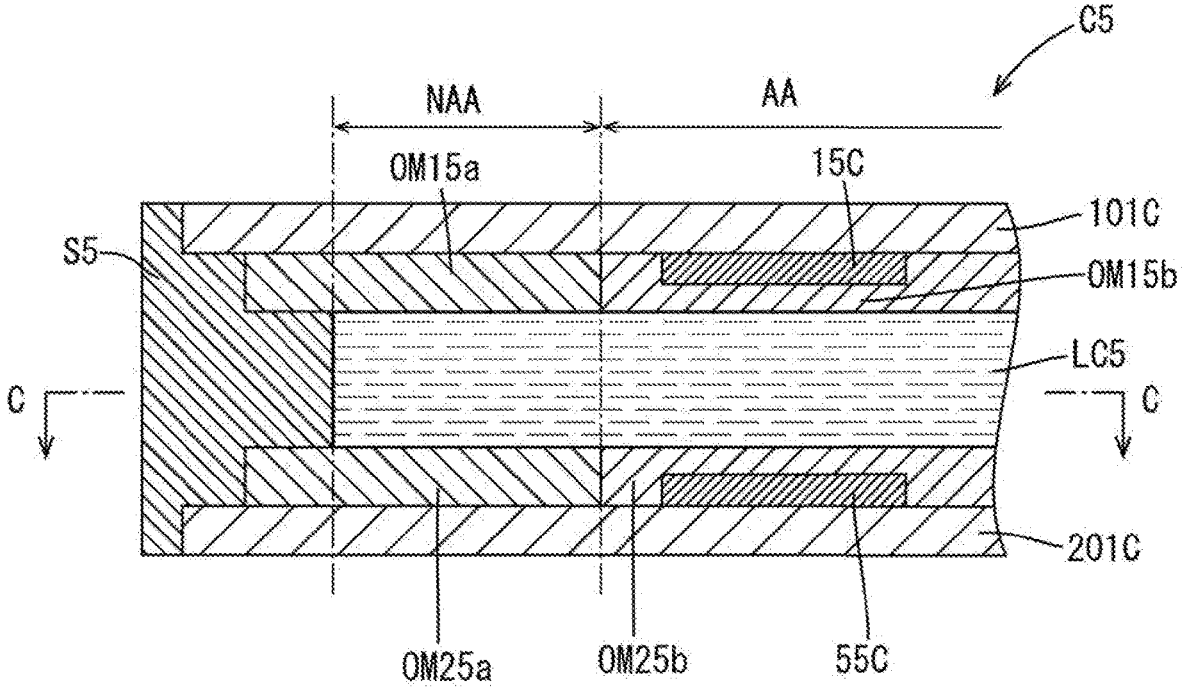
FIG. 11 is an explanatory diagram schematically illustrating a partial cross-sectional configuration of a liquid crystal cell according to a fifth example.
Figure 12:
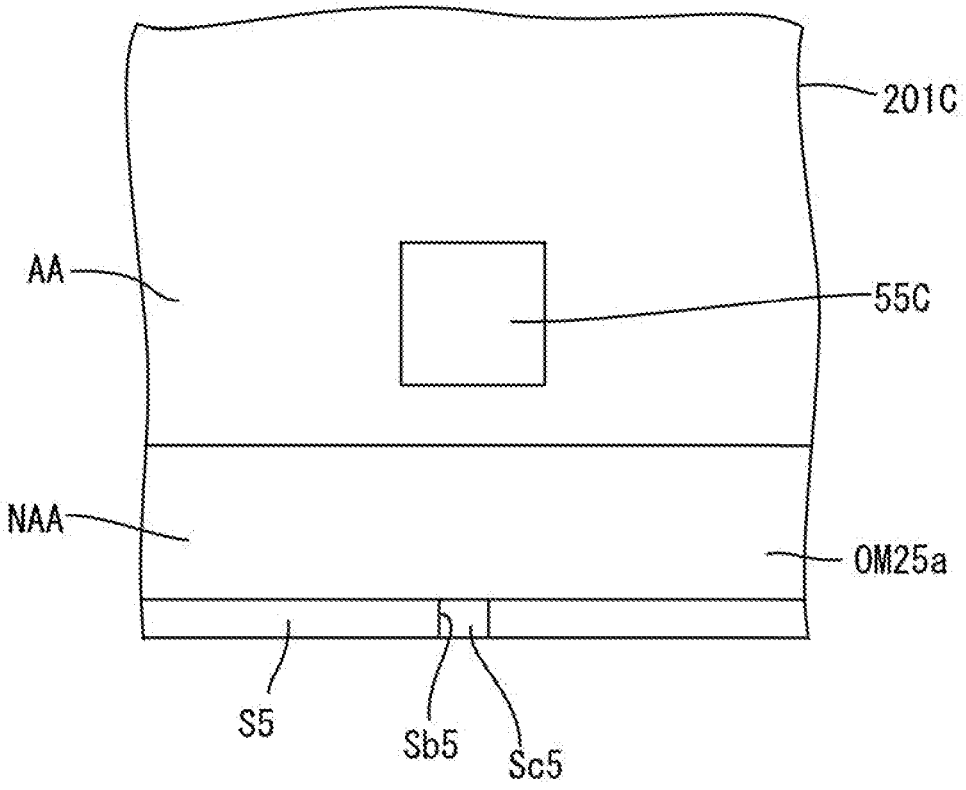
FIG. 12 is a cross-sectional view of FIG. 11 taken along line C-C.

FIG. 11 is an explanatory diagram schematically illustrating a partial cross-sectional configuration of a liquid crystal cell C5 according to a fifth example. FIG. 12 is a cross-sectional view of FIG. 11 taken along line C-C. The configuration of the liquid crystal cell C5 of the fifth example is basically the same as that of the liquid crystal cell C1 of the first example, except for the orientation film. In the liquid crystal cell C5 of the fifth example, as in the first comparative example, orientation films OM15*b* and OM25*b* made of polymer films containing polymethyl methacrylate were respectively formed in an active area AA on surfaces of a TFT substrate 101C and a slot substrate 201C. Then, on the each surface of the TFT substrate 101C and the slot substrate 201C, acidic group-containing orientation films OM15*a* and OM25*a* made of polymer films containing a polymethacrylic acid were formed in a non-active area NAA, the same as in First example. Further, as illustrated in FIG. 12, a sealant S5 is provided with an injection port Sb5 that is closed by a sealing portion Sc5 made of a cured product of a sealing material composition.

As illustrated in FIG. 11, in the liquid crystal cell C5 of the fifth example, a first electrode 15C of the TFT substrate 101C corresponding to a patch electrode and a second electrode 55C of the slot substrate 201C corresponding to a slot electrode face each other in the active area AA with a liquid crystal layer LC5 therebetween. The voltage holding ratio of the liquid crystal cell C5 of the fifth example was evaluated in the same manner as in the first example. As a result, the voltage holding ratio of the fifth example was 30%, a better result than the first comparative example.

Sixth Example

Figure 13:
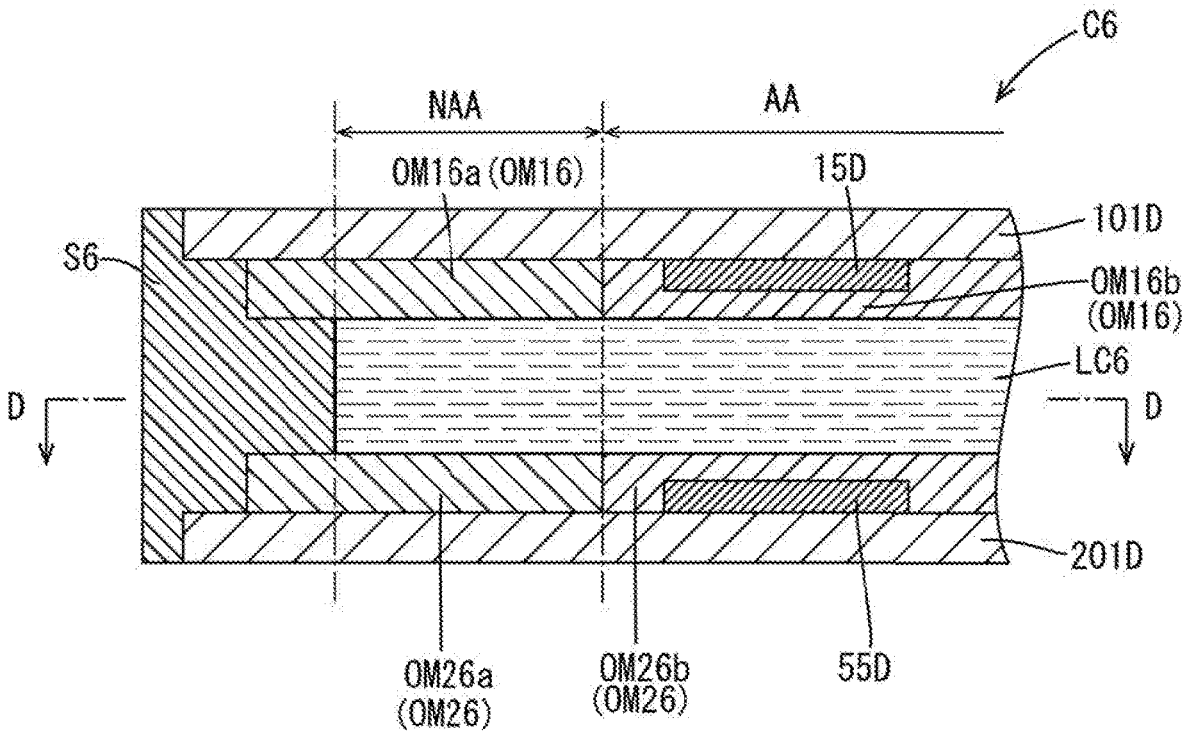
FIG. 13 is an explanatory diagram schematically illustrating a partial cross-sectional configuration of a liquid crystal cell according to a sixth example.
Figure 14:
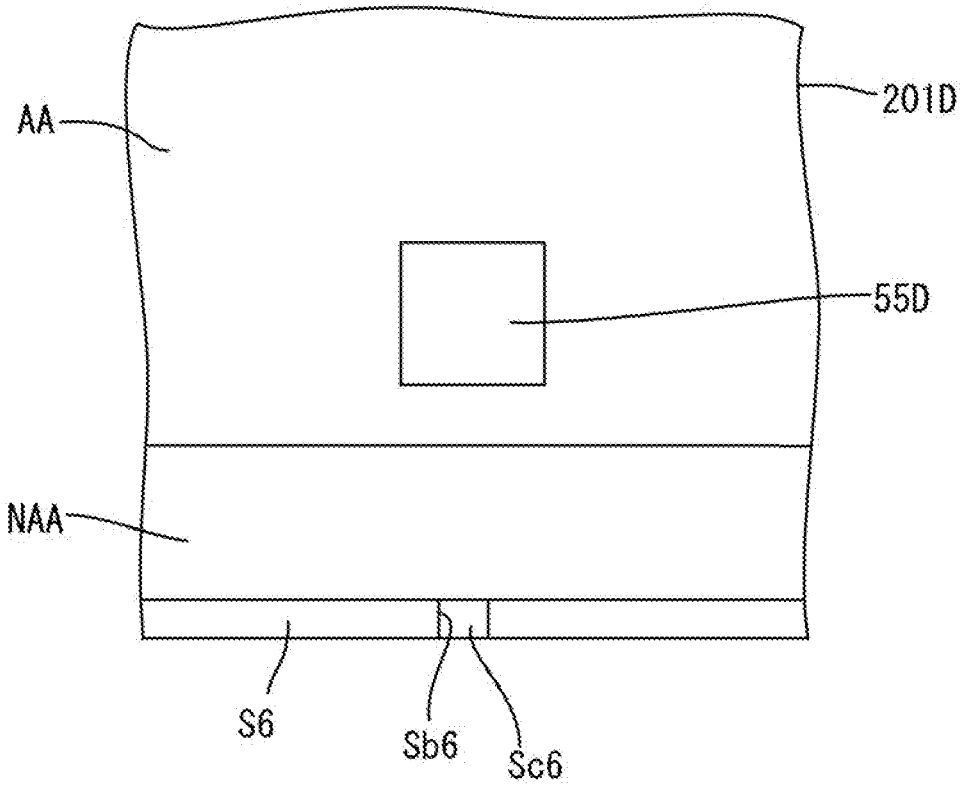
FIG. 14 is a cross-sectional view of FIG. 13 taken along line D-D.

FIG. 13 is an explanatory diagram schematically illustrating a partial cross-sectional configuration of a liquid crystal cell C6 according to a sixth example. FIG. 14 is a cross-sectional view of FIG. 13 taken along line D-D. The configuration of the liquid crystal cell C6 of the sixth example is basically the same as that of the liquid crystal cell C1 of the first example except for the orientation film. In the liquid crystal cell C6 of the sixth example, acidic group-containing orientation films OM16 and OM26 made of polymer films containing a polyimide polymer similar to those of the third example were formed on surfaces of a TFT substrate 101D and a slot substrate 201D as orientation films. Then, out of the acidic group-containing orientation films OM16 and OM26, acidic group-containing orientation films OM16*a* and OM26*a* in a non-active area NAA were not subjected to a rubbing process, and acidic group-containing orientation films OM16*b* and OM26*b* in an active area AA were subjected to a rubbing process. Further, as illustrated in FIG. 14, a sealant S6 is provided with an injection port Sb6 that is closed by a sealing portion Sc6 made of a cured product of a sealing material composition.

As illustrated in FIG. 13, in the liquid crystal cell C6 of the sixth example, a first electrode 15D of the TFT substrate 101D corresponding to a patch electrode and a second electrode 55D of the slot substrate 201D corresponding to a slot electrode face each other in the active area AA with a liquid crystal layer LC6 therebetween. The voltage holding ratio of the liquid crystal cell C6 of the sixth example was evaluated in the same manner as in the first example. As a result, the voltage holding ratio of the sixth example was 90%, a better result than the first comparative example.

The invention claimed is:

1. A liquid crystal cell in which a plurality of antenna units is arrayed, comprising:

a TFT substrate including a first dielectric substrate and a plurality of TFTs supported by the first dielectric substrate and a plurality of patch electrodes electrically connected to the TFTs;

a slot substrate including a second dielectric substrate and a slot electrode supported by the second dielectric substrate and including a plurality of slots;

an acidic group-containing orientation film provided on a surface of at least one of the TFT substrate and the slot substrate and containing a polymer having an acidic group;

a liquid crystal layer interposed between the TFT substrate and the slot substrate in which the patch electrodes and the slot electrode are opposed to each other to constitute the antenna units; and a sealant surrounding the liquid crystal layer and being interposed between the TFT substrate and the slot substrate, wherein the acidic group is a carboxyl group.

2. The liquid crystal cell according to claim 1, wherein the polymer includes a polyimide polymer having a carboxyl group as the acidic group.

3. The liquid crystal cell according to claim 1, wherein the polymer includes an acrylic polymer having a carboxyl group as the acidic group.

4. The liquid crystal cell according to claim 1, comprising:

a non-active area including a frame-shaped area along an inner peripheral edge of the sealant and in which the patch electrodes and the slot electrode constituting the antenna unit are not disposed; and an active area including an area positioned closer to a central side than the non-active area and in which the patch electrodes and the slot electrode constituting the antenna unit are disposed, wherein the acidic group-containing orientation film is provided in at least the non-active area.

5. The liquid crystal cell according to claim 4, wherein the acidic group-containing orientation film is provided in the active area as well as the non-active area.

6. The liquid crystal cell according to claim 4, comprising an injection port shaped such that a part of the sealant is cut away and is used when a liquid crystal material is injected, wherein the acidic group-containing orientation film is formed in at least a region between the injection port and the active area in the non-active area.

7. The liquid crystal cell according to claim 4, wherein at least the acidic group-containing orientation film provided in the non-active area is in a non-orientation state where no orientation processing is performed.

8. A liquid crystal cell in which a plurality of antenna units is arrayed, comprising:

a TFT substrate including a first dielectric substrate and a plurality of TFTs supported by the first dielectric substrate and a plurality of patch electrodes electrically connected to the TFTs;

a slot substrate including a second dielectric substrate and a slot electrode supported by the second dielectric substrate and including a plurality of slots;

an acidic group-containing orientation film provided on a surface of at least one of the TFT substrate and the slot substrate and containing a polymer having an acidic group;

a liquid crystal layer interposed between the TFT substrate and the slot substrate in which the patch electrodes and the slot electrode are opposed to each other to constitute the antenna units; and a sealant surrounding the liquid crystal layer and being interposed between the TFT substrate and the slot substrate, wherein the acidic group is a hydroxyl group.

9. The liquid crystal cell according to claim 8, wherein the polymer includes an acrylic polymer having a hydroxyl group as the acidic group.

10. The liquid crystal cell according to claim 8, comprising:

a non-active area including a frame-shaped area along an inner peripheral edge of the sealant and in which the patch electrodes and the slot electrode constituting the antenna unit are not disposed; and an active area including an area positioned closer to a central side than the non-active area and in which the patch electrodes and the slot electrode constituting the antenna unit are disposed, wherein the acidic group-containing orientation film is provided in at least the non-active area.

11. The liquid crystal cell according to claim 10, wherein at least the acidic group-containing orientation film provided in the non-active area is in a non-orientation state where no orientation processing is performed.

12. The liquid crystal cell according to claim 10, wherein the acidic group-containing orientation film is provided in the active area as well as the non-active area.

13. The liquid crystal cell according to claim 10, comprising an injection port shaped such that a part of the sealant is cut away and is used when a liquid crystal material is injected, wherein the acidic group-containing orientation film is formed in at least a region between the injection port and the active area in the non-active area.

14. A liquid crystal cell in which a plurality of antenna units is arrayed, comprising:

a TFT substrate including a first dielectric substrate and a plurality of TFTs supported by the first dielectric substrate and a plurality of patch electrodes electrically connected to the TFTs;

a slot substrate including a second dielectric substrate and a slot electrode supported by the second dielectric substrate and including a plurality of slots;

an acidic group-containing orientation film provided on a surface of at least one of the TFT substrate and the slot substrate and containing a polymer having an acidic group;

a liquid crystal layer interposed between the TFT substrate and the slot substrate in which the patch electrodes and the slot electrode are opposed to each other to constitute the antenna units;

a sealant surrounding the liquid crystal layer and being interposed between the TFT substrate and the slot substrate;

a non-active area including a frame-shaped area along an inner peripheral edge of the sealant and in which the patch electrodes and the slot electrode constituting the antenna unit are not disposed; and an active area including an area positioned closer to a central side than the non-active area and in which the patch electrodes and the slot electrode constituting the antenna unit are disposed, wherein the acidic group-containing orientation film is provided in at least the non-active area.

15. The liquid crystal cell according to claim 14, wherein the acidic group is a carboxyl group.

16. The liquid crystal cell according to claim 14, wherein the polymer includes a polyimide polymer having a carboxyl group as the acidic group.

17. The liquid crystal cell according to claim 14, wherein the polymer includes an acrylic polymer having a carboxyl group as the acidic group.

18. The liquid crystal cell according to claim 14, wherein at least the acidic group-containing orientation film provided in the non-active area is in a non-orientation state where no orientation processing is performed.

19. The liquid crystal cell according to claim 14, wherein the acidic group-containing orientation film is provided in the active area as well as the non-active area.

20. The liquid crystal cell according to claim 14, comprising an injection port shaped such that a part of the sealant is cut away and is used when a liquid crystal material is injected, wherein the acidic group-containing orientation film is formed in at least a region between the injection port and the active area in the non-active area.

* * * * *